US006479737B1

(12) United States Patent
Lebeda

(10) Patent No.: US 6,479,737 B1
(45) Date of Patent: Nov. 12, 2002

(54) SYSTEM AND METHOD FOR EMITTING LASER LIGHT FROM A DRUMSTICK

(76) Inventor: Francis C. Lebeda, 2514 White Eagle Trail SE., Cedar Rapids, IA (US) 52403

( * ) Notice: Subject to any disclaimer, the term of this patent is extended or adjusted under 35 U.S.C. 154(b) by 0 days.

(21) Appl. No.: 09/389,945

(22) Filed: Sep. 3, 1999

Related U.S. Application Data

(63) Continuation-in-part of application No. 09/115,531, filed on Jul. 15, 1998, now abandoned.

(51) Int. Cl.[7] ..... G10D 13/02

(52) U.S. Cl. ..... 84/422.4

(58) Field of Search ..... 84/422.4

(56) References Cited

U.S. PATENT DOCUMENTS

| | | | | | |
|---|---|---|---|---|---|
| 3,722,350 | A | * | 3/1973 | Cordes | 84/422.4 |
| 4,226,163 | A | * | 10/1980 | Welcomer | 84/422.4 |
| 4,632,006 | A | * | 12/1986 | Ambroszewski | 84/422.4 |
| 4,722,035 | A | * | 1/1988 | Rapisarda | 362/109 |
| 5,212,333 | A | * | 5/1993 | Aryee | 84/477 R |
| 5,718,496 | A | * | 2/1998 | Feldman et al. | 353/42 |
| 5,818,036 | A | * | 10/1998 | Daly | 250/216 |

* cited by examiner

*Primary Examiner*—Shih-Yung Hsieh
(74) *Attorney, Agent, or Firm*—Simmons, Perrine, Albright & Ellwood, P.L.C.

(57) ABSTRACT

A drumstick with a laser disposed therein for emitting light to be shown upon a distant object which may include a photo detector coupled with audio visual equipment to be controlled, via drumstick, by a musician.

4 Claims, 3 Drawing Sheets

SYSTEM AND METHOD FOR EMITTING LASER LIGHT FROM A DRUMSTICK

CROSS REFERENCE TO RELATED APPLICATIONS

This application is a continuation in part application of application Ser. No. 09/115,531 filed on Jul. 15, 1998, abandoned by Francis C. Lebeda for "TUBULAR DRUMSTICK OR BATON WITH LASER OR HIGH-INTENSITY LIGHT INSERT".

FIELD OF THE INVENTION

The present invention generally relates to musical instruments, and more particularly relates to drumsticks, batons, and drum mallets, and even more particularly relates to a system and method for emitting laser light from a drumstick, baton, or mallet.

BACKGROUND OF THE INVENTION

In the past, designers of drumsticks have endeavored to provide drumstick systems with the capability of making the tip of the drumstick become illuminated. One crucial element in such systems has been the use of an encapsulating transparent tip which surrounds a light source disposed at the tip of the drumstick. One example of such a drumstick is described in U.S. Pat. No. 4,722,035 entitled "DRUMSTICK WITH LIGHT EMITTING DIODE" issued to Rapisarda. Another example is U.S. Pat. No. 4,226,163 entitled "ILLUMINATED DRUMSTICKS" issued to Welcomer.

While these illuminated tip drumsticks have some advantages, such as enhancing the visual effect of a drummer's performance when observers are watching the drummer play, they also have significant drawbacks.

First of all, the encapsulating material around the light source tends to have a dimming effect on the light which can be observed.

Secondly, the location of the light source at the tip of the drumstick affects the weight and balance of the drumstick.

Thirdly, the location of the light source at the tip of the drumstick, where impact occurs, results in mechanical shocks being transmitted to the light source.

SUMMARY OF THE INVENTION

It is an object of the present invention to provide enhanced visual performance of a baton twirler, drummer or other percussion instrument musician.

It is a feature of the present invention to include a hollow drumstick with a laser disposed in the handle.

It is an advantage of the present invention to reduce the undesired impact forces affecting the light source during use of the drumstick.

It is another feature of the present invention to include a tip having a light-emitting orifice therein.

It is another advantage of the present invention to allow laser light to be transmitted undisturbed by any tip material, to a distant object or objects.

The present invention is an apparatus and method for emitting laser light from a drumstick, baton or mallet which are designed to satisfy the aforementioned needs, provide the previously stated objects, include the above-listed features, and achieve the already articulated advantages. The present invention is carried out with an "encapsulating tip-less" instrument tip in a sense that attenuation of light caused by passage of light through an encapsulating tip material has been greatly reduced.

Accordingly, the present invention is a system and method for emitting laser light from an instrument having a light emitting orifice therein through which laser light is allowed to pass.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
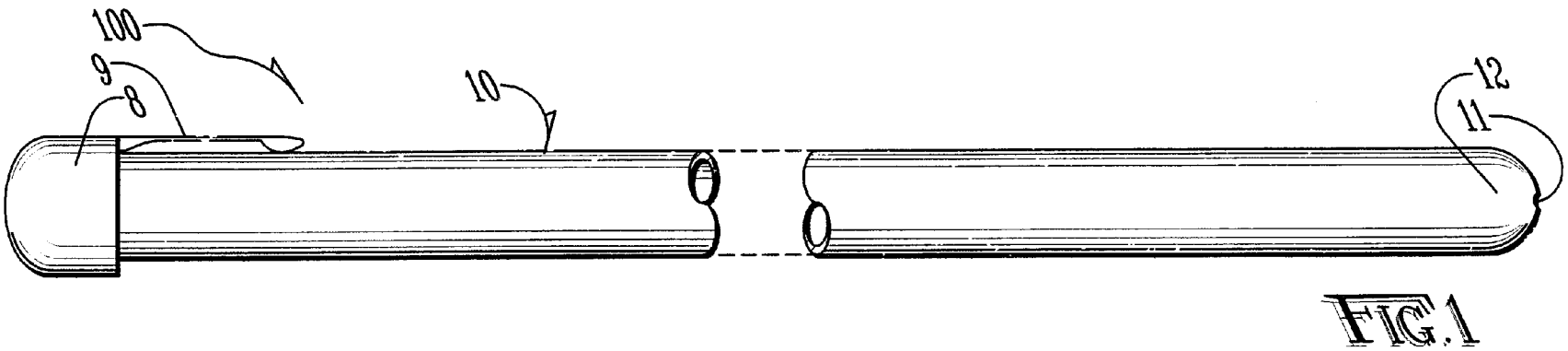
FIG. 1 is a simplified side view of a drumstick of the present invention.

Now referring to the drawings, wherein like numerals refer to like matter throughout, and more particularly to FIG. 1, there is shown a side view of drumstick of the present invention, generally designated, 100, having a hollow drumstick shank 10, a drumstick tip 12 with a light emitting orifice 11 therein. Disposed at an opposite end from drumstick tip 12 is retaining cap 8 and retaining clip 9. The materials used to construct the drumsticks, caps, clips etc. throughout this detailed description are a matter of designer's choice and may include various material such as wood, nylon, aluminum, other metals, fiberglass, carbon fiber, Kevlar reinforced fiberglass, plastics, and any other suitable material for a drumstick.

Figure 2:
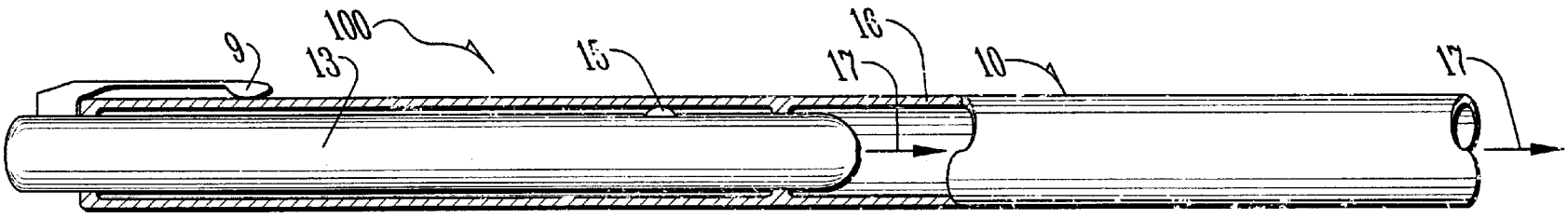
FIG. 2 is a partial cut-away side view of portions of the drumstick of FIG. 1.

Now referring to FIG. 2, there is shown a partial cut-away side view of portions of the drumstick, 100, of FIG. 1. Drumstick shank 10 has a cut-away section 16, therein exposing an inwardly disposed laser insert 13 with said retaining clip 9 coupled thereto. Laser insert 13 shows coupled thereto a compression ball bearing switch 15 disposed thereon. (Laser insert 13 may be similar to laser 308 described below.) When laser insert 13 is placed inside of drumstick shank 10, the compression ball bearing switch is compressed, due to the tight fit of the laser insert 13 into the drumstick shank 10. This compression of compression ball bearing switch 15 causes the laser insert to emit laser light. When the musician no longer desires the laser insert 13 to emit light, the musician merely removes the laser insert 13 from the drumstick shank 10, thereby releasing the pressure on compression ball bearing switch 15, which terminates the laser emission. When laser insert 13 is disposed in drumstick shank 10, the laser emission occurs in a focused beam 17 which travels through the hollow drumstick shank 10 in a direction which is parallel with the longitudinal direction of drumstick shank 10. Note that the placement of the laser insert 13 at the retaining cap 8 (not shown in FIG. 2) end of the drumstick shank 10 results in a weight balance characteristic of the drumstick 100 being shifted toward the retaining cap 8 end, the handle end, of the drumstick 100. However, many of the advantages of the present invention can be achieved with a drumstick having the laser disposed at the drumstick tip 12 (FIG. 1) end of the drumstick shank 10 or at any intermediate position within the drumstick shank 10. The present invention and the claims below are intended to include all such variations in design.

Figure 3:
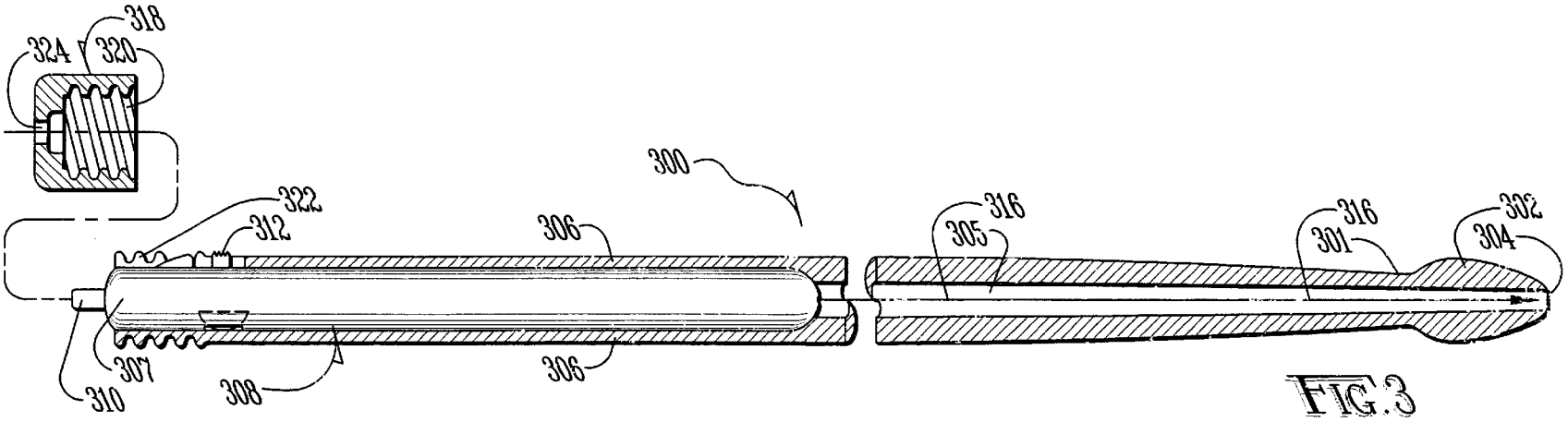
FIG. 3 is a cross-sectional side view of a drumstick of the present invention, where the centerline represents a laser beam.

Now referring to FIG. 3, there is shown a tapered drumstick, generally designated 300, of the present invention, which shows a bulbous tip 302, for striking a drum. Tip 302 has a laser light-emitting orifice 304 therein. Preferably, orifice 304 has no encapsulating cover or lens material; however, in some alternate embodiments, transparent covers and/or lenses or other optical devices, such as beam splitters, prisms, etc., could be place in, at, or about orifice 304. Drumstick 300 has a hollow core 305 surrounded by a tapered drumstick shank 306 which has a decreasing diameter characteristic along a line extending from the laser end 307 toward the tip end 301 where the bulbous tip 302 reverses the decreasing diameter characteristic. Disposed inside of hollow core 305 at the laser end 307 of drumstick 300 is laser 308, which may be any laser, super luminescent diode, or other high intensity light source capable of emission of a high intensity focused beam of light. A preferred laser 308 is a 650 nm wave length, maximum output less than 5 mW Class 111A laser product, which is commercially available and well known in the industry. It should be understood that numerous other lasers or light sources could be substituted, depending upon the particular design requirement for the drumstick being designed. Also, it should be understood that laser 308 may be disposed in or at any point of the hollow core 305 from laser end 307 to the orifice 304. Laser 308 is shown having several examples of switches thereon. Rear switch 310 represents a switch on the non-light-emitting end of laser 308, which could be actuated by pressing a button on the rear switch 310 or by twisting a cap 318 having grooves 320 therein for cooperation with threads 322 on said drumstick so as to advance and retract when twisted. Said threads and grooves can be reversed or substituted with other surface features. Also shown is a handle end orifice 324 which could be used to allow a switch to extend or be manipulated therethrough, or in an alternate embodiment, the laser 308 could be reversed to emit a beam out the handle orifice 324. This may be desirable for various purposes, including educational or instructional use. For example, the beam can be used to assist an instructor in determining how the drumstick is being held and used by a student.

Also shown is an exterior switch 312 disposed on the exterior of the drumstick 300. Either switch 312 is a sliding switch disposed in a slot in the drumstick shank 306, or button switch disposed through a hole. Various other common switches could be used as well. A compression ball bearing switch, similar to switch 15 of FIG. 2, could be used if laser 308 is designed to be removed when not in use. Irrespective of which switch type is used, laser 308 emits light in a narrow focused beam 316, which passes through hollow core 305 and exits through orifice 304 and continues in a straight narrow focused beam until striking and thereby illuminating matter located a distance away from the tip 302, causing such matter to reflect light in a direction other than merely back in the direction of the narrow focused beam 316. This illumination of distant objects is a key advantage of the present invention. If smoke, fog, mist, dust or other small airborne particles are present in the environment around the drumstick 300, a line of light may be seen extending away from the orifice 304. This line of light is the result of scattering of the narrow focused-beam 316 off these airborne particles, resulting-in a dramatic and entertaining performance by the musician using the drumstick. This is especially entertaining when the drummer twirls, tosses, and otherwise manipulates the drumstick in a manner that the orifice 304 is pointed in a direction away from the drum surface.

Figure 4:
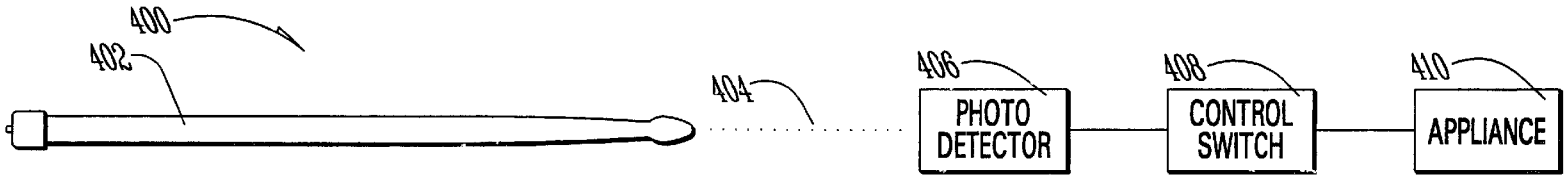
FIG. 4 is a block diagram of a light show system of the present invention, which utilizes the drumstick of FIG. 1 to remotely control a lighting system around a musician.

Now referring to FIG. 4, there is shown a block diagram of an appliance control system of the present invention generally designated 400, having a drumstick 402 of the present invention as described above for FIGS. 1–3, which emits a laser beam 404 which is aimed by the musician to hit a photo detector 406 which cooperates with control switch 408 to affect the operation of an appliance 410, which may be a lighting or sound system to be controlled by the musician.

While the present invention has been heretofore described as a drumstick, it should be understood that many of the advantages of the present invention can be achieved with alternate embodiments of the present invention, such as batons used by drum majorettes and baton twirlers etc., as well as in mallet like instruments used to strike larger drums. In such cases, the dimensions, shape, and design details of the instrument are usually quite different from the drumsticks described herein in detail, but it should be understood that the present invention and the claims herein are intended to include such alternate embodiments of the present invention.

It is thought that the method and apparatus of the present invention will be understood from the foregoing description and that it will be apparent that various changes may be made in the form, construct steps, and arrangement of the parts and steps thereof without departing from the spirit and scope of the invention or sacrificing all of their material advantages. The form herein described is merely a preferred exemplary embodiment thereof.

I claim:

1. A system comprising:

a drumstick having an exterior surface, a hollow core, a tip end and handle end;

said drumstick having an orifice therein;

a laser disposed in said hollow core for emitting a beam of light through said orifice and illuminating objects disposed outwardly of said exterior surface; and wherein said laser is a super luminescent diode.

2. A system comprising:

a drumstick having an exterior surface, a hollow core, a tip end and handle end;

said drumstick having an orifice therein;

a laser disposed in said hollow core for emitting a beam of light through said orifice and illuminating objects disposed outwardly of said exterior surface;

wherein said orifice is in said tip end;

wherein said laser is disposed in said handle end;

wherein said tip end is a bulbous section of said drumstick, wherein said drumstick has a decreasing diameter characteristic along a line extending from said handle end to said tip end; and wherein said laser is a super luminescent diode.

3. A system comprising:

a drumstick, having therein a laser for emitting light in a beam;

a photo detector for sensing a reception of said light emitted from said drumstick;

an appliance for generating a response which is perceivable to a human observer;

a switch, responsive to said photo detector, and coupled to said appliance for manipulating an operational characteristic of said appliance in response to said photo detector;

whereby said light emitted from said drumstick can be used to control said appliance.

4. A system of claim 3 wherein said appliance is a device for generating visible light.

* * * * *